US007722410B2

(12) United States Patent
De Dios Martin et al.

(10) Patent No.: US 7,722,410 B2
(45) Date of Patent: May 25, 2010

(54) PLUG

(75) Inventors: Longinos De Dios Martin, Barcelona (ES); Maria Maqueda Gonzalez, Barcelona (ES)

(73) Assignee: Tyco Electronics AMP Espana SA, Barcelona (ES)

( * ) Notice: Subject to any disclaimer, the term of this patent is extended or adjusted under 35 U.S.C. 154(b) by 0 days.

(21) Appl. No.: 12/086,239

(22) PCT Filed: Nov. 21, 2006

(86) PCT No.: PCT/GB2006/004328

§ 371 (c)(1),
(2), (4) Date: Jun. 9, 2008

(87) PCT Pub. No.: WO2007/068875

PCT Pub. Date: Jun. 21, 2007

(65) Prior Publication Data

US 2009/0163082 A1 Jun. 25, 2009

(30) Foreign Application Priority Data

Dec. 14, 2005 (GB) ..... 0525435.4

(51) Int. Cl.
*H01R 24/00* (2006.01)

(52) U.S. Cl. ..... 439/676

(58) Field of Classification Search ..... 439/676, 439/344, 941, 318
See application file for complete search history.

(56) References Cited

U.S. PATENT DOCUMENTS

| | | | | |
|---|---|---|---|---|
| 6,250,949 | B1 | 6/2001 | Lin | |
| 6,402,559 | B1 * | 6/2002 | Marowsky et al. | 439/676 |
| 6,406,325 | B1 * | 6/2002 | Chen | 439/418 |
| 6,793,515 | B1 * | 9/2004 | Gwiazdowski et al. | 439/344 |
| 2001/0012722 | A1 | 8/2001 | Adams | |

FOREIGN PATENT DOCUMENTS

| | | |
|---|---|---|
| EP | 0 716 477 A2 | 6/1996 |
| EP | 1 248 329 A | 10/2002 |

OTHER PUBLICATIONS

Search Report and Written Opinion for PCT/GB2006/004328 issued by the European Patent Office on Feb. 14, 2007.
Search Report for GB0525435.4 issued by The Patent Office (GB) on Mar. 2, 2006.

* cited by examiner

*Primary Examiner*—Briggitte R Hammond
(74) *Attorney, Agent, or Firm*—Baker & Daniels LLP

(57) ABSTRACT

A RJ-45 plug having a wire holder for arranging conductors of a twisted pair cable between a position at which they are twisted and an end position where they contact contacts within the plug, the wire holder providing conductor paths in more than one plane.

10 Claims, 5 Drawing Sheets

PLUG

The present invention relates to a plug, often referred to as a modular plug, for terminating cables for use in telecommunications and other data transmission applications, such as high speed links in local area networks.

In the past, cables carrying telecommunications traffic were hard wired to the equipment to which they were to be connected. Recently, however, it has become usual to terminate such cables by means of modular plugs which can then be easily mated with sockets on the equipment concerned.

An early example of such a plug is disclosed in U.S. Pat. No. 3,954,320 (Hardesty) which discloses an electrical connector for terminating a cord having a plurality of insulated conductors and for making electrical contact external to the connector, the connector comprising a unipartite dielectric housing having a cavity for receiving an end portion of the cord, and having a plurality of electrically conductive terminals positioned within the housing for piercing the insulation of conductors of the cord. The connector disclosed is the original of the type of connector now well known by the term RJ-11 which is a four pin connector for connecting telephone handsets to telephones and for connecting the telephone to a wall socket.

Various standards are now in place governing the performance of such plugs and the cables that they terminate. This is necessary to ensure that products from different manufacturers will perform together. The present invention is of particular, though not exclusive, use in meeting a particular such standard, to be described in more detail below.

The current standard of interest, issued in 2002, is known as "Category 6". Category 6 has more than twice the band width capacity of Category 5e cabling. The cabling has greatly improved immunity from external noise and greatly improved resistance to crosstalk. As a result, Category 6 can support multi-gigabit applications.

Category 6 cabling is terminated using plugs of the RJ series, and RJ-45 plugs, which are used with cables carrying four pairs of conductors, are of particular interest for the present invention.

RJ stands for registered jack, and it is a general term for electrical plugs for telecommunications. The general arrangement of such plugs, and their numbering system, was set out by the Bell System as the Universal Service Order Code introduced in the 1970's by AT&T. They are registered with the US Federal Communications Commission under 47 CFR 68.502. The Category 6 standard was published in June 2002 by the Category 6 Consortium and has the reference ANSI/TIA/EIA-568-B.2-1. All of these standards are very well known in the art.

As mentioned above, an important consideration for cables and plugs meeting these standards is that crosstalk is very low, immunity from external noise is very high, and therefore they can support very high band-width. The usual way of reducing or eliminating crosstalk is to employ the conductors within a cable in the form of twisted pairs. Usually, of course, there are several twisted pairs within a single outer jacket. In the case of Category 6 cables for use with RJ-45 plugs there will be eight conductors arranged as four twisted pairs. Crosstalk can be reduced or eliminated by means of twisted pairs because the net electrical field generated around a twisted pair is substantially zero (because the two conductors are of opposite polarity) and therefore the effects of capacitance between twisted pairs is minimised. Furthermore, twisted pairs can be largely immune to external electrical noise because such noise affects equally both conductors of the pair and therefore cancels.

A problem arises when a twisted pair cable is terminated at a plug because the conductors will in general need to be untwisted in order to connect them to the contacts in the plug. The length over which the twisted pairs are untwisted is, in good designs of plug, reduced to a minimum. Nonetheless, some length of untwisted conductors remains and this puts an upper limit on the band width and rate of data transmission applicable to the cable.

EP 0716477 (The Whittaker Corporation) discloses a modular plug for high speed data transmission in which this problem is largely overcome at least for the category of cable with which that invention was concerned. That specification discloses an assembly comprising a modular plug and a cable having pairs of twisted wires for connection thereto, the plug comprising a housing, contacts for connection to wire ends of the wires, and a wire holder receivable in a cavity of the housing, the wire holder comprising a housing having a base wall, top wall, side walls and wire receiving cavities extending there through from a wire receiving face to a contact end face, characterised in that the wire holder comprises a base extension positionable below the contacts within the housing cavity for positioning straightened wire ends of the cable extending along the base extension below the contacts for connection thereto, wherein the pairs of twisted wires are in a twisted pair configuration up to the wire receiving face of the holder.

An important feature of that invention is, therefore, the wire holder. This component, which may also be referred to as a load bar, is essentially an adaptor to arrange the wires in the correct order and correct special configuration between the position between where they cease to be twisted and the extreme distal end of the conductors where they meet the electrical contacts of the plug. The load bar may be made of any suitable material, and it will in general comprise a dielectric material.

When the wire holder or load bar of that prior art device is installed it is done so first by untwisting the twisted pairs and threading each conductor through holes in the load bar and then pushing the load bar back towards the cable end as far as it will go against the portions of the conductors that remain twisted together. Any excess of the conductors protruding through the opposite face of the load bar are then trimmed away.

An important feature is the base extension of the wire holder, and the distal ends of the conductors lie along this base extension which in the assembled plug lies underneath a row of insulation-displacement contacts. The various conductors, at least in preferred embodiments, enter the wire holder in a single plane which coincides with the plane of the base extension.

In a variation of the design illustrated in that patent specification, and embodied in a product marketed by Tyco Electronics (and known as "Wire Holder, 8 position, rd cable, Mod Plug, Cat 6") for terminating a four pair cable, the wire holder has four wire-receiving cavities extending there through. The wire-receiving cavities together constitute substantially all of the cross-sectional area of the wire holder. In other words the walls that define the cavities are thin. The four cavities are substantially mutually parallel, and substantially parallel to the axis of the wire holder. In this existing design there are two outer cavities, leading respectively to the far left hand and far right hand pairs of contacts at the base extension; and two central cavities, one on top of the other, and leading to the two central pairs of cavities. The upper of those central cavities may be open in cross-section, or in other words have no upper wall or "roof". The internal walls defining the four cavities have the appearance in end elevation of a capital letter "H".

These cavities, which are about 8.7 mm long do not guide the conductors in a very precise path and, because they are substantially parallel they do not force or allow the conductors to follow an optimum path from the arrangement they have in the cable to their final parallel arrangement at the base extension where they are to make electrical connection to the overlying contacts.

We have now found that for the increased performance demanded of Category 6 cabling some disadvantages with at least some embodiments of these prior art designs can arise. We have also found out that greater electrical performance can be achieved if the conductors entering the wire holder do so in such a fashion that they do not all follow substantially parallel paths to that position where they lie under the insulation-displacement contacts. In preferred embodiments of the present invention the wire holder is provided with a ramped surface or protrusion for some only of the conductors, the others following a more direct path through (or on) the wire holder. This arrangement appears to reduce crosstalk and provides greater immunity from external noise, possibly by reducing the length over which the conductors of any given pair are considered as being untwisted.

Thus, the present invention provides a plug (such as an RJ-45) for terminating a cable (preferably a Category 6 cable) having at least one twisted pair of insulated conductors, comprising:

(a) a housing having a cavity therein;

(b) contacts for connection to the conductors and for insertion into a socket into which the plug is to be received; and (c) a wire holder receivable into the cavity and having conductor-receiving paths, optionally dimensioned to receive only a single conductor or only a single pair of conductors at least at the first position, and extending there through for arranging the conductors between a first position where they are twisted and a second position at which they are untwisted and at which they are to be connected to the contacts, in which the wire holder has at least one wire-deflecting surface, preferably in the form of a ramp or protrusion, such that when the conductors are inserted into said paths, the conductors are forced to follow different directions and preferably are forced to lie in more than one plane.

The plug preferably has a base portion at said second position, the base portion having, for each conductor, a conductor receiving path lying in substantially a single plane. This arrangement makes it easier for one to provide a series of contacts contacting each conductor and themselves lying in a single plane for connection to a standard socket where in turn the conductors of the socket lie in a single plane.

We prefer that the holder have a first surface extending from said first position to or towards said second position that receives some only of the insulated conductors, and a second surface preferably comprising at least part of said wire-deflecting surface and extending from said first position to or towards said second position that receives others of the insulated conductors, at least the second surface being non-rectilinear in the direction of the conductors.

Additionally or alternatively, the holder may have a first surface extending from said first position to or towards said second position that receives some only of the insulated conductors, and a second surface preferably comprising at least part of said wire-deflecting surface and extending from said first position to or towards said second position that receives others of the insulated conductors, in which all conductors at said second position lie substantially in a single plane, and in which all said conductors at said first position do not lie in that same plane.

The second surface preferably forms at least part of a ramp, preferably at or adjacent the first position. The second surface may alternatively or additionally form at least part of a ramp at the second position, generally leading forwards and down to the contact level. The ramp at the first position and the ramp at the second position may be integral or joined to one another (optionally forming up and down surfaces of a single ramp) or they may be at least partially separate. In any case, the ramp at the second position which directs the conductors to the contacts is preferably steeper than the ramp at the first position.

The plug of the invention preferably meets the RJ-45 specification.

Additionally or alternatively, the plug of the invention has a wire holder that is shaped and dimensioned:

(a) to separate some of the conductors from others of the conductors, and/or (b) to limit the co-planar length of the untwisted conductors;

the separating (a) and/or the limiting (b) being sufficient to enable the plug in operation to meet the Category 6 standard published in June 2002 by the Category 6 Consortium under reference ANSI/TIA/EIA-568-B.2-1.

The electrical contacts are preferably insulation-displacement contacts. In this case they will usually be provided with a sharp, insulation-piercing, or otherwise displacing portion usually mounted in the housing, and facing the wire holder. Once the conductors have been placed in the wire holder and the wire holder placed in the housing, the contacts are moved, for example by the use of a crimping tool, to drive them into the insulation. A portion of the contacts will usually remain exposed at, or accessible from, an external surface of the plug so that the plug may merely be slid into a socket and connection automatically made. Each contact is preferably of a unitary structure, or at least include a unitary portion that serves both to displace the insulation of the conductors and to be accessible from an external surface of the plug. The contacts will usually be made of a resilient metal.

The present invention is further illustrated in conjunction with the accompanying drawings, in which.

Figure 1:
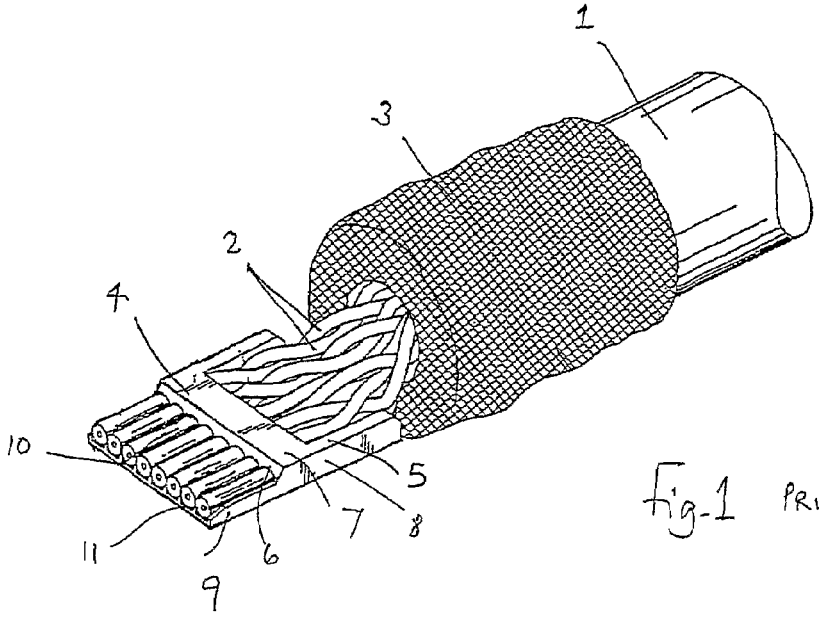
Fig-1 PRIOR ART
FIG. 1 shows a wire holder or load bar at the end of a twisted pair cable as disclosed in EP 0716477.
Figure 2:
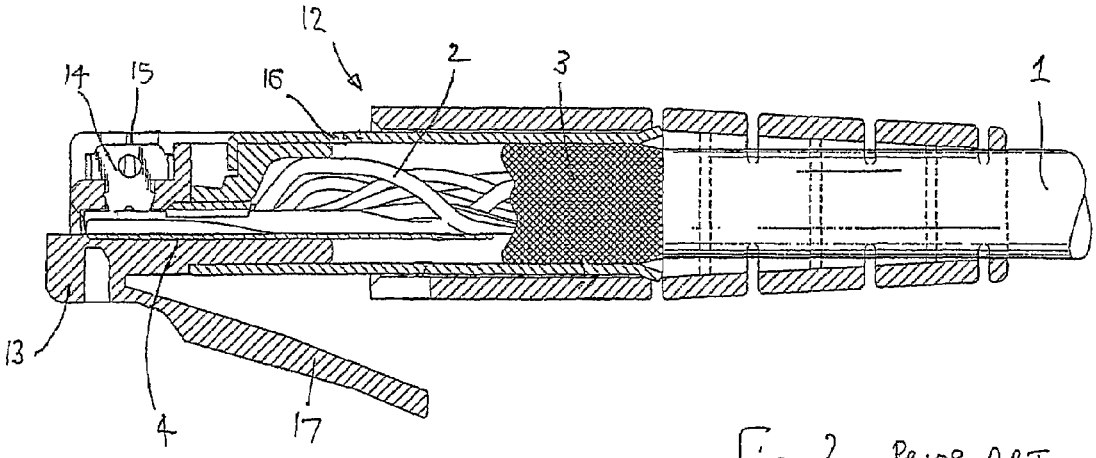
Fig. 2 PRIOR ART
FIG. 2 shows a twisted pair cable terminated by a plug as disclosed in EP 0716477.

FIGS. 1 and 2 are taken from EP 0716477. FIG. 1 shows a twisted pair cable (1) containing several twisted pairs (2) of insulated conductors. A screening layer (3) can be seen to have been turned back over the cable jacket to expose the twisted pairs (2). The extreme ends of the twisted pairs (2) have been untwisted to enable them to lie parallel to one another in order that they may be inserted into a wire holder or load bar (4). The wire holder (4) has a receiving end (5) and a contact end (6) through which holes are provided for the insulated conductors. The wire holder (4) has a top wall (7) and side walls (8), and a base having an extension (9) onto which the straightened conductors lie.

It is preferred that the conductors remain twisted until they reach the wire receiving end (5), and as a result are untwisted for the minimum possible length. It is necessary that they lie in a single plane parallel to one another over the forward extension (9) in order that they be able to contact overlying contacts in the plug housing into which the wire holder (4) is to be inserted.

The wire holder (4) has a front trimming end (10) adjacent to which the conductors are trimmed after insertion. The front extension (9) can be seen to have wire receiving grooves (11) on its surface to aid alignment of the conductors.

FIG. 2 shows a twisted pair cable (1) terminated by the plug of EP 0716477 of which the wire holder (4) of FIG. 1 forms a part. The modular plug as a whole is referred to by reference 12. The plug (12) has a housing (13) into which the wire holder (4) has been inserted. Also provided are insulation-displacing contacts (14), one for each of the conductors, and positioned such that the contacts can be displaced by for example a crimping tool downwards as drawn onto the conductor ends that lie above the forward extension (9) of the wire holder (4). A top (as drawn) portion (15) of each contact (14) is accessible from outside of the plug (12) such that when the plug is inserted into a socket, contacts within the socket make contact with portion 15.

Other components illustrated include a conductor shield (16) within the plug that contacts the turned back shielding (3) of the cable (1). Also shown is a tang (17) which retains the plug in a socket.

Figure 3:
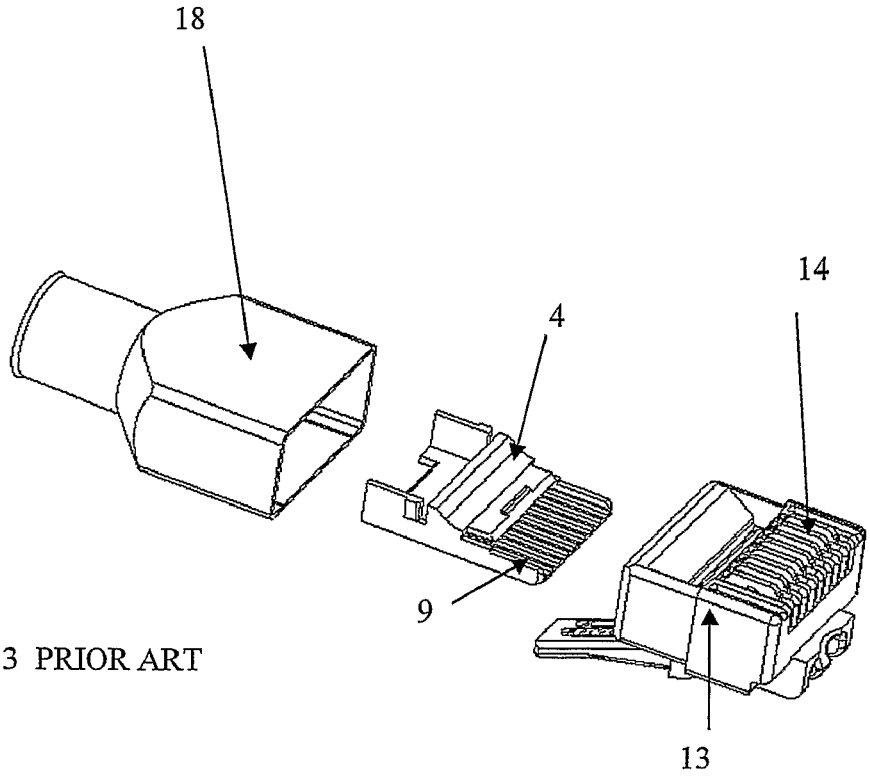
Fig. 3 PRIOR ART
FIG. 3 shows in perspective a plug of that prior art showing the various components partially separated.
Figure 4:
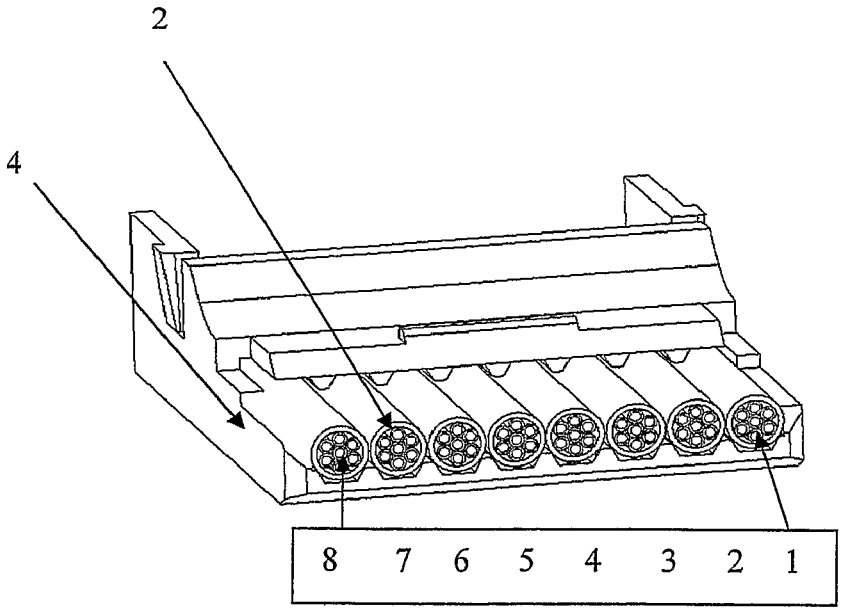
Fig. 4 PRIOR ART
FIG. 4 shows the same prior art wire holder in end elevation.

FIG. 3 shows partially disassembled a prior art plug to be installed at an end of a twisted pair cable. The wire holder (4) is ready for organising twisted pairs, the ends of which will lie on the forward extension of the base (9) of the wire holder (4), prior to its insertion into housing (13). The housing (13) can be seen to contain eight insulation-displacement contacts (14), which when depressed vertically as shown will contact the conductors within the wires lying on the extension (9). FIG. 4 shows an end elevation of the wire holder (4) showing the ends of eight conductors (2) which are numbered for correlation with the colour coding of the conductors according to the standards for RJ-45 plugs.

It can be seen from these figures that the function of the wire holder is to position all of the eight wires in a specific figuration to provide a transition between the end of the cable and the contacts within the housing. As mentioned above, the pairs should remain twisted over as much of their length as possible. If there is any considerable extent of conductors untwisted behind the wire holder then performance of the terminated cable will be impaired.

In the present invention performance is improved by modifying the shape of the wire holder between the position where the conductors enter and the position where the contacts are made over the forward extension of the base (9). The arrangement of conductors on this forward extension may, but need not, be identical to that disclosed in EP 0716477. In that prior art all eight conductors are parallel to one another and lie in a single plane throughout the entire length of the wire holder (4). This is not the case in the wire holder used in the present invention.

Figure 5A:
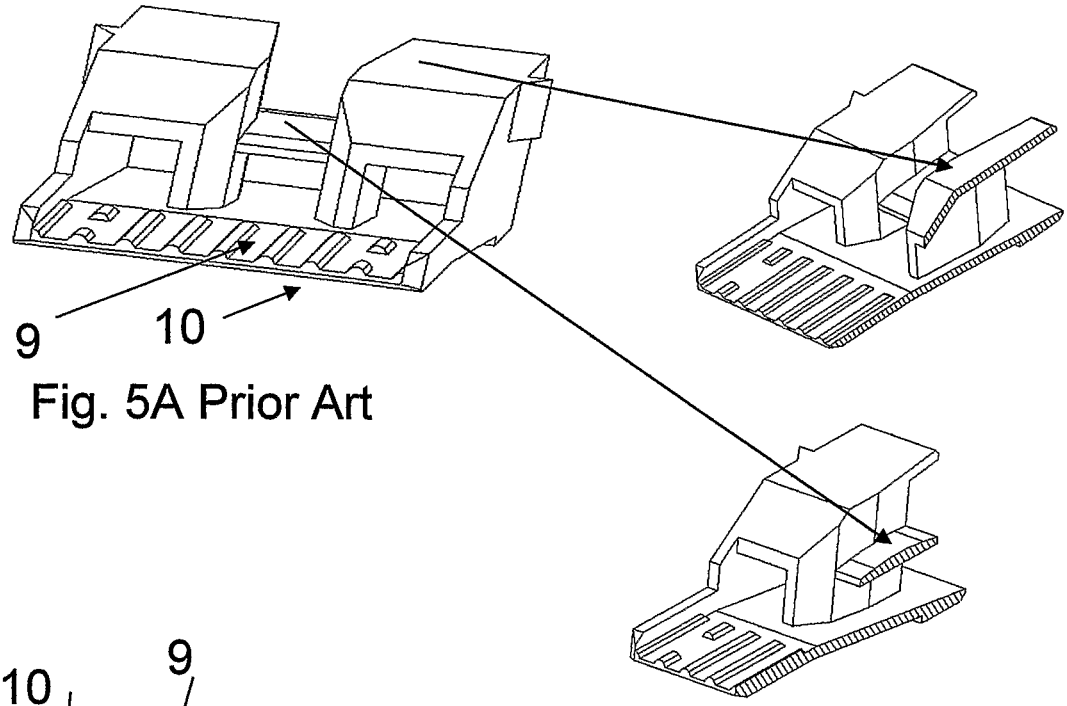
Fig. 5A Prior Art
FIG. 5 shows three views of a variation of that prior art wire holder.
Figure 5B:
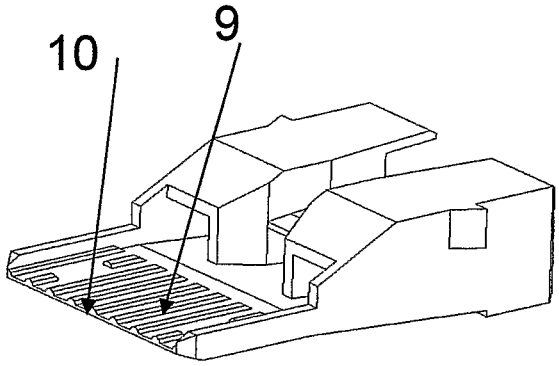
Fig. 5B Prior Art
Figure 5C:
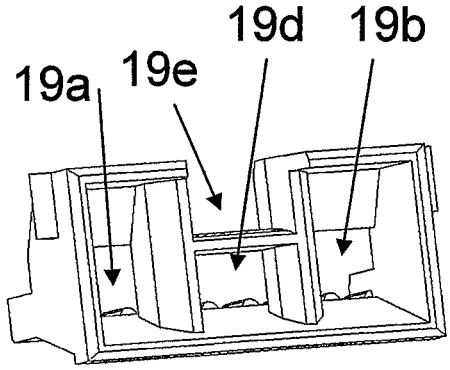
Fig. 5C Prior Art

FIGS. 5A, 5B and 5C show a prior art design of wire holder that is a variation of that illustrated in EP0716477. This design was referred to above. This wire holder shares with that illustrated in EP 0716477 the base extension 9 terminating in a wire trimming end 10. However, it can be seen, particularly from FIG. 5C, that the wire holder has four cavities 19 through which conductors are to pass. The cavity 19*a* at the far left is for conductors 1 and 2 as referred to in FIG. 4, the cavity 19*b* at the far right is for conductors 7 and 8 (see FIG. 4). The two central cavities 19*c* and 19*d*, one on top of the other are for the two central pairs of conductors 3,4,5 and 6 (see FIG. 4). In FIG. 5C the internal walls defining the cavities can be seen to have the appearance of a capital letter "H", and the top cavity 19*c* can be seen to be open in cross-section. Although the wire holder causes the various conductors to follow different paths, those paths are aligned substantially mutually parallel. This design does not allow the optimum separation between pairs of conductors over the region where they are untwisted, combined with the minimum extent of untwisting.

Figure 6:
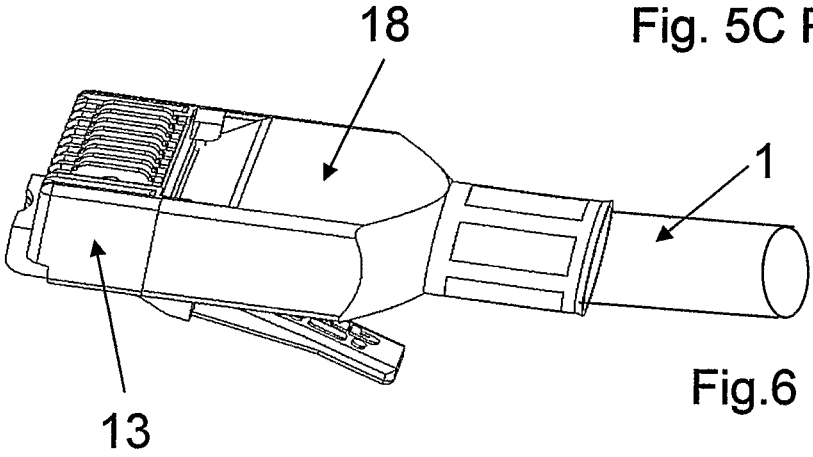
FIG. 6 shows a plug of the invention terminating a twisted pair cable.

The new plugs are shown in FIG. 6, terminating a twisted pair cable (1). The new wire holder is enclosed within housing (13), partially surrounded by an outer cover (18) which may provide electrical shielding or other protection.

Figure 7:
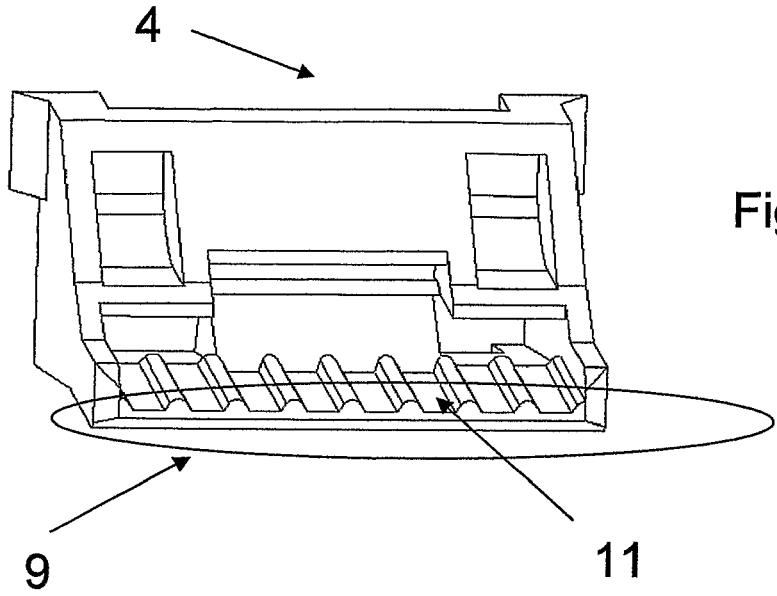
FIG. 7 is an end elevation of a wire holder of the invention within a housing.
Figure 8:
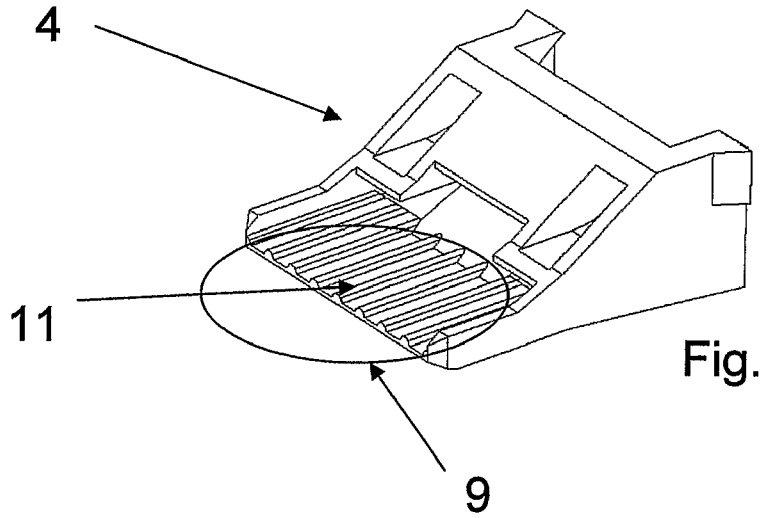
FIG. 8 is a perspective view of a wire holder of the invention.

The shape of the new wire holder (4) is shown in FIG. 7 looking in a direction backwards into the cable (1) when present in use. Thus, the forward extension of the base (9) is seen closest to the viewer, and this base can be seen to include a series of wire receiving grooves (11). The conductors therefore enter the wire holder from the back as drawn. The new wire holder includes a protuberance, or other deflecting means (20), which causes some of the conductors to lie in a plane different from that of others of the conductors. In the embodiment illustrated the two conductors that would lie at the far left and the two conductors that would lie at the far right (corresponding to conductors 8, 7, 2 and 1 in FIG. 4) will lie in a common plane and will follow substantially straight paths through the wire holder (4). In contrast, the four conductors at the center (corresponding to conductors 6, 5, 4 and 3 of FIG. 4) will pass over the protuberance (20) and thus will be deflected into a different plane. Other arrangements could be used causing conductors other than the central four conductors to be displaced. It can be seen from FIG. 8 that the conductor ends on the front extension of the wire holder (4) will remain parallel to one another and in a common plane, located within the wire-receiving grooves (11).

Figure 9:
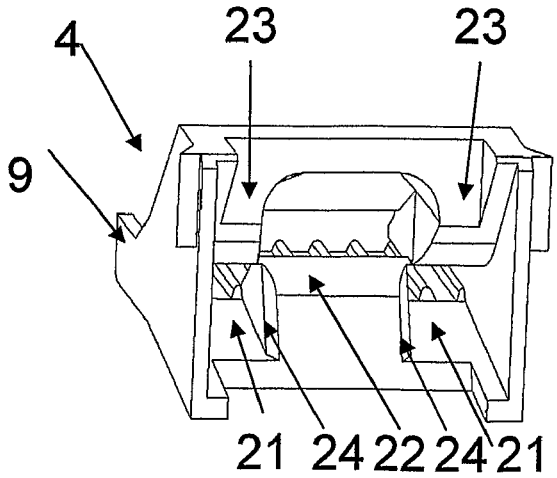
FIG. 9 is a rear view of a wire holder of the invention.

A rear view (i.e. looking towards the distal end of the cable) of a wire holder (4) is shown in FIG. 9. Protuberance or ramp (20) is illustrated. The presence of protuberance (20), in this case again in the centre of the wire holder, gives rise to the different paths (21) and (22) that different conductors follow in the passage from the rear of the wire holder to the forward extension (9) where they are to make electrical connection to insulation-displacement contacts. Paths (21) at the outside positions are linear, and path (22) over the protrusion (20) causes the central four conductors to follow a non-linear path and to lie in a different plane from that of the outside conductors. The upper parts of the side walls have curved, or other suitably shaped (for example angular) surfaces 23. The protuberance and/or the curved surfaces 23 can serve as wire-deflecting surfaces such that when the conductors are inserted into the holder (into the page as drawn in FIG. 9) conductors positioned at or near the bottom of the cable will be deflected up the ramp, conductors at or near the left hand side of the cable will pass through the left hand path 21, conductors at or near the right hand side of the cable will pass through the right hand path 21 and conductors at or near the top of the cable will be guided by the upper curved surfaces 23. The sides of the protuberance may also be curved as shown at 24 to guide conductors at or near the bottom of the cable. In the design illustrated the wire holder is therefore of a three cavity construction, rather than four cavity construction of FIG. 5. The various curved (or angled) surfaces of this design allows the conductors to be guided correctly whatever the precise positioning and orientation of the conductors of the cable to be terminated. Each of these features in inventive in itself, and the invention also provides a wire holders and plugs employing each of these features in the presence or absence of the others. These designs make it very easy to assemble the plug on the end of a cable, and in general it will be possible to insert all eight conductors simultaneously into the wire holder.

The precise size of the components of the plug will of course depend on the precise application. However, in many cases the height of the ramp will be from 0.8 to 1.3 mm, particularly from 0.9 to 1.2, and especially about 1.1 mm. The height of the ramp will govern the separation between the conductors that pass over it and those that follow paths 21. In fact, we prefer that the height of the ramp is from 0.8 to 1.2 times, preferable from 0.9 to 1.1 times, the diameter of the insulated conductors. It can be seen that the centre and the side pairs lie in different planes and straight runs of conductors do not lie next to other straight runs, until the connection area on the base extension.

The separation between the top of the ramp and the top wall, and between the sides of the ramp and the side walls, will generally only allow the conductors to be arranged mutually parallel and therefore untwisted. Usually the minimum separation is 1.1 or 1.15 mm. The small dimensions reduce variations possible in assembly, reducing the possibility of error.

Figure 10:
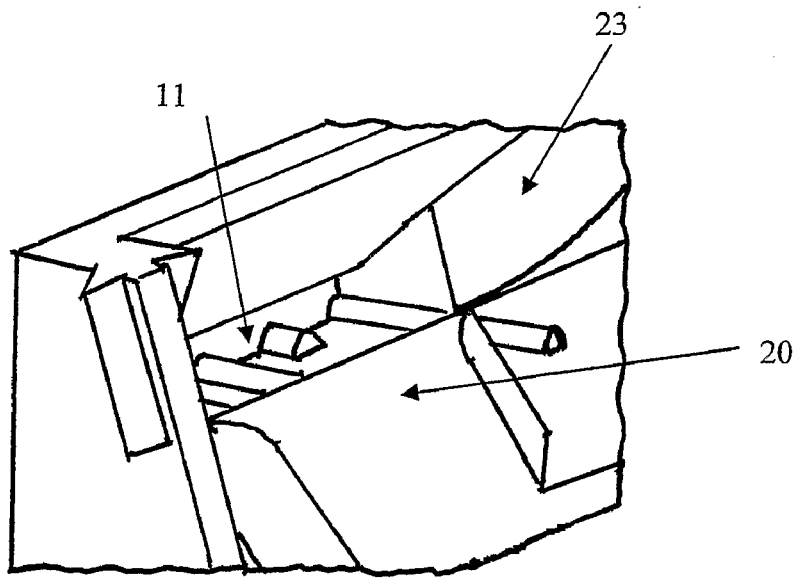
FIG. 10 shows a detail of the wire holder of the invention.

A detail from FIG. 9 is shown in FIG. 10. Again, the wire-receiving grooves (11) are shown.

Figure 11:
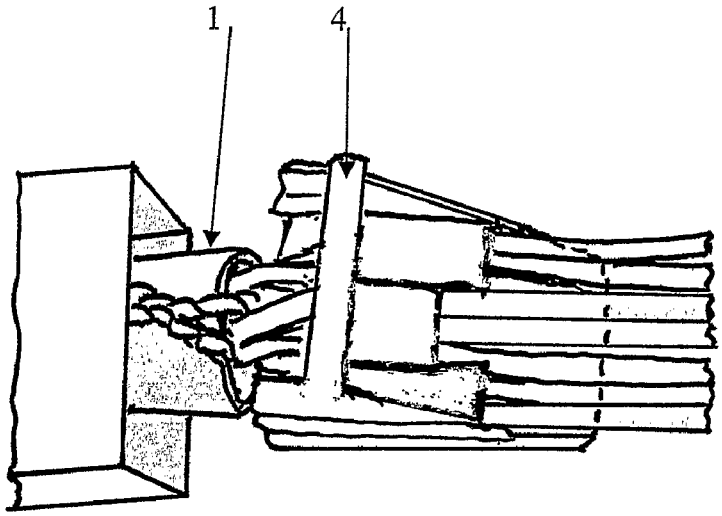
FIG. 11 shows a wire holder of the invention positioned at the end of a twisted pair cable.

FIG. 11 shows the wire holder (4) of the invention at the end of a twisted pair cable (1). It can be seen that all of the conductors do not lie in the same plane as they pass from one end of the wire holder to the opposite end.

In summary, therefore, it can be seen that in the preferred embodiment illustrated the outside conductors (conductors 1, 2, 7 and 8 as arranged in FIG. 4) remain in the same plane throughout the wire holder (4). The central conductors (conductors 3, 4, 5 and 6 as arranged in FIG. 4) lie in the same plane as the other conductors at the forward extension of the base (9) where contact is to be made, but just rearward of that position (away from the end of the cable) they are forced or are allowed to follow a path in a different plane. As a result, the length of the wire holder may be shorter than alternative designs and this can reduce the length over which the wires must be untwisted for termination.

What is claimed is:

1. A plug for terminating a cable having at least one twisted pair of insulated conductors, comprising:

(a) a housing having a cavity therein;

(b) contacts for connection to the conductors and for connection to a socket into which the plug is to be received; and (c) a wire holder receivable into the cavity and having conductor-receiving paths extending there through for arranging the conductors between a first position where they are twisted and a second position at which they are untwisted and at which they are to be connected to the contacts, the wire holder comprising a base portion at said second position, the base portion having, for each conductor, conductor-receiving paths lying in a substantially single plane, and at least one wire-deflecting surface such that when the conductors are inserted into said paths, the conductors are forced to follow different directions, some following a linear path and others following a non-linear path to lie in a plane different from that of the linear path conductors.

2. A plug according to claim 1, in which the wire holder has a first surface extending from said first position to or towards said second position that receives some only of the insulated conductors, and a second surface extending from said first position to or towards said second position that receives others of the insulated conductors, the conductors extending from said first position to or towards said second position do not lie in that same plane.

3. A plug according to claim 2, in which said second surface forms at least part of a ramp at or adjacent the first position.

4. A plug according to claim 2, in which the second surface forms at least part of a ramp at or adjacent the second position.

5. A plug according to claim 1, for terminating a cable having at least four twisted pairs of insulated conductors, the plug having at least eight of said contacts (b), and the holder (c) having at least eight of said conductor-receiving paths.

6. A plug according to claim 5, meeting the RJ-45 specification.

7. A plug according to 1, wherein the wire holder is shaped and dimensioned: (a) to separate some of the conductors from others of the conductors, and/or (b) to limit the co-planar length of the untwisted conductors; the separating (a) and/or the limiting (b) being sufficient to enable the plug in operation to meet the Category 6 standard published in June 2002 by the Category 6 Consortium under reference ANSI/TIA/EIA-568-B.2-1.

8. A plug according to claim 1, in which the contacts comprise insulation-displacement contacts.

9. A plug according to claim 1, in which each contact comprises a unitary structure that can contact a said conductor and is exposed at, or is otherwise accessible from, an external surface of the plug for contacting a conductor within said socket.

10. A plug according to claim 1, wherein each conductor-receiving path is dimensioned to receive only a single conductor.

* * * * *